US005630720A

United States Patent [19]

Kocher

[11] Patent Number: 5,630,720

[45] Date of Patent: May 20, 1997

[54] SELF POLARIZING ELECTRICAL CONTACT

[75] Inventor: Timothy L. Kocher, Camp Hill, Pa.

[73] Assignee: The Whitaker Corporation, Wilmington, Del.

[21] Appl. No.: 724,436

[22] Filed: Oct. 1, 1996

Related U.S. Application Data

[63] Continuation of Ser. No. 412,044, Mar. 28, 1995, abandoned.

[51] Int. Cl.[6] ..... H01R 9/09

[52] U.S. Cl. ..... 439/78; 439/678; 439/680; 439/716

[58] Field of Search ..... 439/78, 83, 678, 439/680, 716, 717

[56] References Cited

U.S. PATENT DOCUMENTS

| | | | |
|---|---|---|---|
| 3,244,848 | 4/1966 | Chapin et al. | 439/716 |
| 3,372,365 | 3/1968 | Bedocs | 439/680 |
| 4,239,324 | 12/1980 | Stenz | 439/716 |
| 4,533,889 | 8/1985 | Knight | 439/78 |
| 4,721,471 | 1/1988 | Mueller | 439/78 |
| 4,741,703 | 5/1988 | Johnescu et al. | 439/78 |
| 4,818,237 | 4/1989 | Weber | 439/693 |
| 5,158,471 | 10/1992 | Fedder et al. | 439/80 |
| 5,174,787 | 12/1992 | Shirai et al. | 439/489 |
| 5,199,880 | 4/1993 | Arai | 439/65 |
| 5,204,799 | 4/1993 | Stibila | 361/119 |
| 5,226,825 | 7/1993 | Ricci, Jr. et al. | 439/70 |
| 5,238,412 | 8/1993 | Morishita et al. | 439/83 |
| 5,240,422 | 8/1993 | Kobayashi et al. | 439/78 |
| 5,321,585 | 6/1994 | Trittschuh, III et al. | 361/784 |
| 5,336,117 | 8/1994 | Mizuguchi et al. | 439/717 |
| 5,423,120 | 6/1995 | Kaneko | 439/405 |

FOREIGN PATENT DOCUMENTS

| | | | |
|---|---|---|---|
| 2001690 | 12/1970 | Germany | 439/717 |
| 143582 | 6/1990 | Japan | 439/708 |

OTHER PUBLICATIONS

Abstract and drawings – Serial No. 08/412,177/Filing Date Mar. 28, 1995.

Abstract and drawings – Serial No. 08/356,620/Filing Date Dec. 15, 1994.

*Primary Examiner*—Gary E. Elkins

[57] ABSTRACT

An electrical contact (10) including a body portion (12) having first and second connecting sections (30, 40) at opposite ends thereof, and at least three legs (32 34, 36) extending from a common end (18) of the body portion (12) altogether comprising one of the first and second connecting sections (30, 40) of the contact (10). The first (32) of the at least three legs is spaced from a second leg (34) by a selected first distance ($d_1$) and the second leg (34) is spaced from the third leg (36) by a selected second distance ($d_2$). The first distance ($d_1$) is different from the second distance ($d_2$). The at least three legs (32, 34, 36) are adapted to be received in respective through-holes (52, 54, 56) of a circuit board (50) in a polarized arrangement.

6 Claims, 4 Drawing Sheets

SELF POLARIZING ELECTRICAL CONTACT

This application is a continuation of application Ser. No. 08/412,044 filed Mar. 28, 1995, now abandoned.

FIELD OF THE INVENTION

This invention relates generally to electrical contacts and in particular to electrical contacts that are mounted to circuit board and an electrical connector assembly therefor.

BACKGROUND OF THE INVENTION

When mounting electrical connectors to circuit boards it is desirable that the connector and board include polarization features to assure that the connector is properly positioned to the board before mounting it thereto. Polarization features can include for example, molding asymmetrical posts on the bottom of a connector housing, inserting one or more specialized contacts at selected locations in a connector housing or using a separate metal or plastic member disposed in the housing.

SUMMARY OF THE INVENTION

The present invention is directed to an electrical contact that is self-polarizing. The electrical contact includes a body portion having first and second connection sections at opposite ends thereof and at least three legs extending from a common end of the body portion all together comprising one of the first and second connecting sections of the contact. The first of the at least three legs is spaced from the second leg a selected first distance and the second leg is spaced from the third leg a selected second distance, the first distance being different from the second. The at least three legs are adapted to be received in respective through-holes of a circuit board in a polarized arrangement.

The invention is further directed to a connector assembly including a housing having at least one electrical contact disposed therein that includes the polarized arrangement defined above. The housing may further include additional self-polarizing contacts or a variety of other contacts. By virtue of this structure, the connector assembly thus defined needs no other polarizing feature to align it correctly on the board.

The self-polarizing electrical contact is particularly suitable for use with power and ground contacts which typically have a plurality of contact tails.

The contact of the present invention is cost effective to manufacture and eliminates the need for other polarizing features for a connector to be mounted to a circuit board.

The preferred embodiments of the invention will now be described by way of example with reference to the accompanying drawings.

DETAILED DESCRIPTION OF THE DRAWINGS

Figure 1:
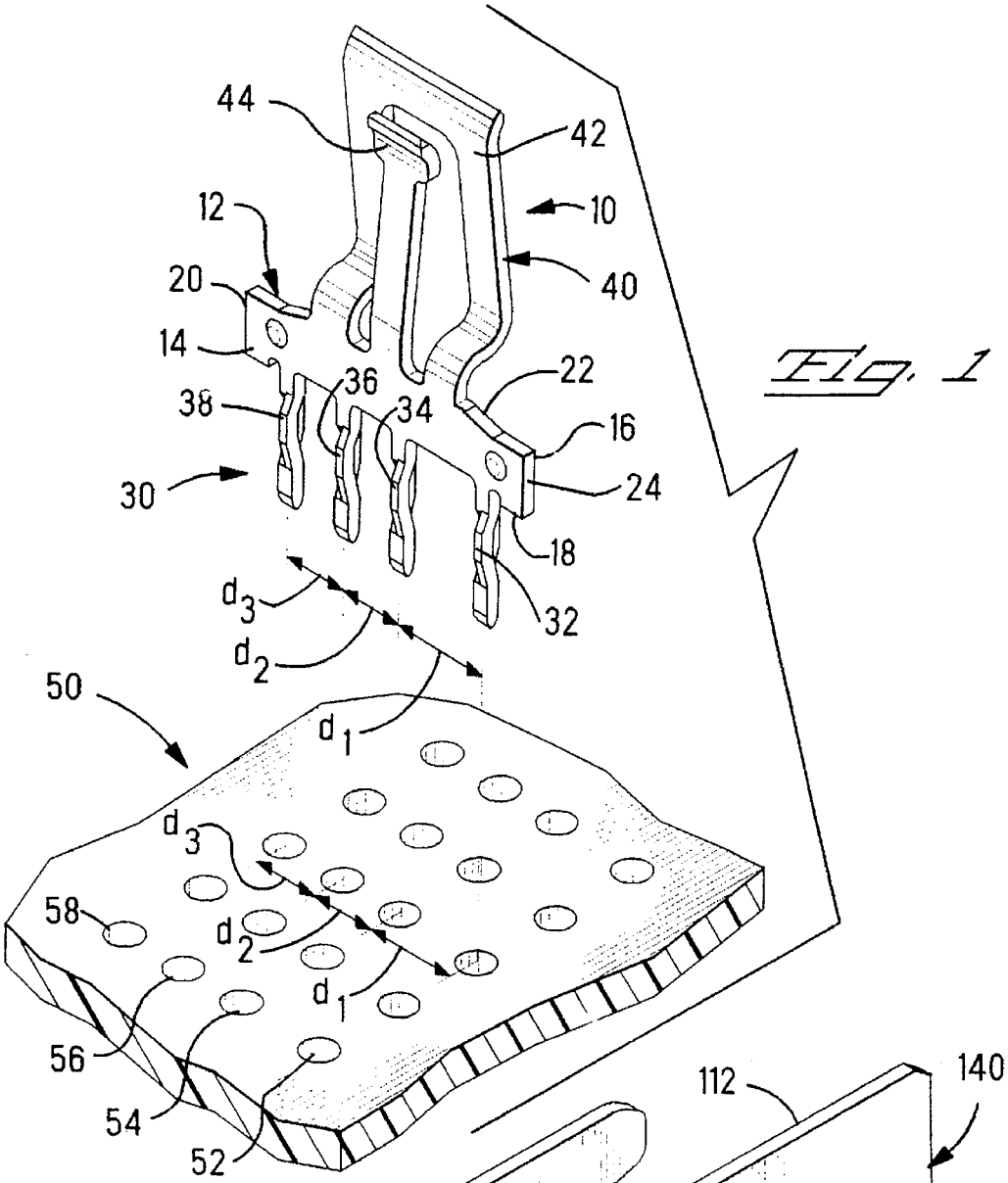
FIG. 1 is a perspective view of an electrical contact made in accordance with the invention and exploded from a circuit board.

The present invention will be illustrated with reference to a receptacle contact 10 of the type suitable for use when conducting power, ground or signals. It is to be understood that the self-polarizing feature may be used with contacts of other configurations. The electrical contact 10 of FIG. 1 includes a body portion 12 having first and second connecting sections 30, 40 at opposite ends thereof. The body portion 12 has opposed first and second major surfaces 14, 16 and edges 18, 20, 22 and 24. The first connecting section 30 includes a plurality of contact legs 32, 34, 36 and 38 extending from edge 18 of the body portion 12. The first leg 32 of this array of contact legs is spaced from a second leg 34 at a first selected distance $d_1$. The second leg 34 is spaced from the third leg 36 by a selected second distance $d_2$ and the third and fourth legs 36, 38 are respectively separated by a distance $d_3$. In accordance with the invention, the first distance $d_1$ is different from the second distance $d_2$. In the embodiment shown the distance $d_2$ is identical to $d_3$ although it need not be as long as the contact legs are not all equally spaced apart but are asymmetrical with respect to an axis parallel to the contact legs. The first, second, third and fourth legs 32, 34, 36 and 38 are adapted to be received in corresponding first, second third and fourth through-holes 52, 54, 56 and 58 respectively on a circuit board 50. For purposes of illustrating the invention the second connecting section is shown as an arrangement of spring arms 42 and 44 adapted to receive a blade contact (not shown). It is to be understood that the second connecting section is not to be limited by this configuration.

The contact of the present invention is preferably stamped and formed from a flat strip of metal such as phosphor bronze or other suitable materials having the desired spring characteristics. The contact 10 being a substantially flat member is readily reversed in a housing arrangement to provide a different polarization arrangement for a different pattern on the circuit board.

Figure 2:
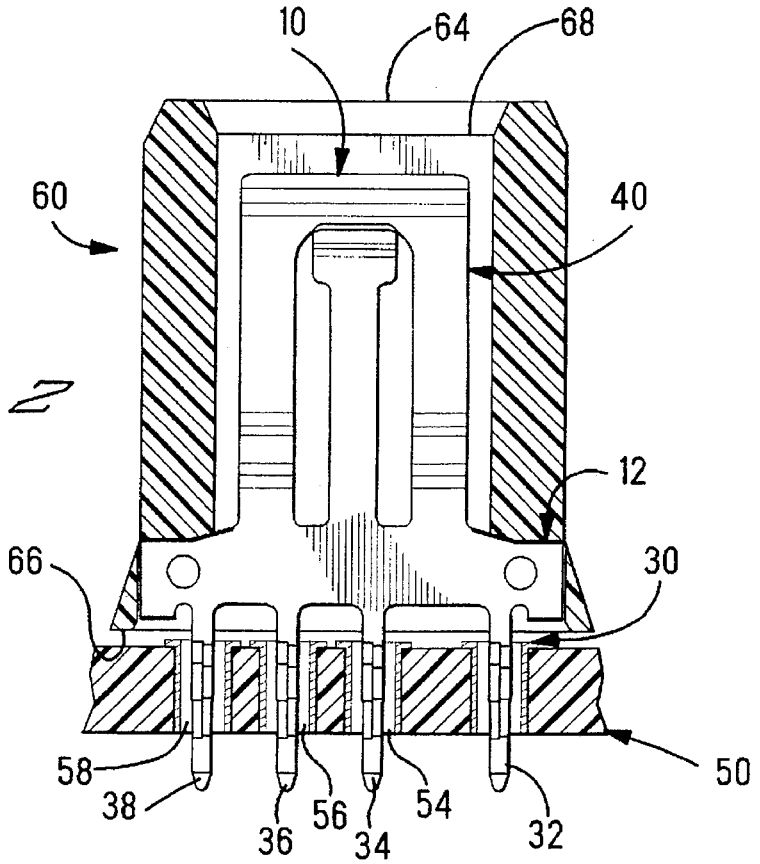
FIG. 2 is a cross-sectional view of a connector assembly having a contact of FIG. 1 disposed therein and mounted to a circuit board in one of its possible orientations.
Figure 3:
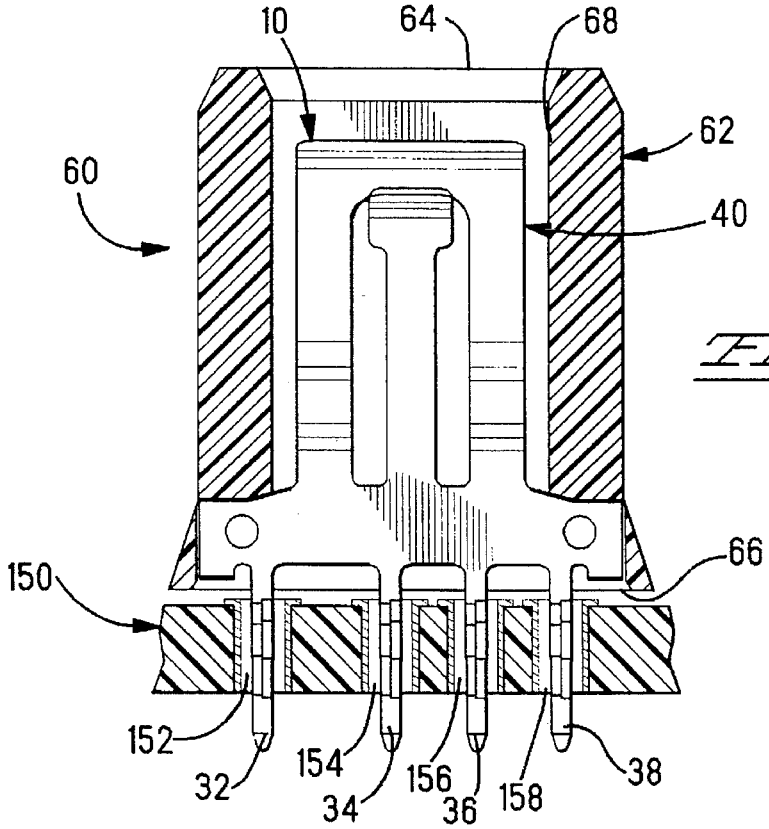
FIG. 3 is a view similar to FIG. 2 showing the electrical contact in its second polarized orientation.

FIGS. 2 and 3 show a representative electrical connector 60 including a housing 62 having a mating face 64, a mounting face 66 and a contact receiving cavity 68 configured to receive electrical contact 10. These figures show a connector assembly 60 mounted to respective circuit boards 50, 150 with the contact 10 in its two polarized orientations. FIG. 2 shows electrical contact 10 in a first orientation with the assembly mounted to board 50 with the first terminal leg 32 disposed in through-hole 52 and the second, third and fourth contact legs 34, 36 and 38 disposed in through-holes 54, 56 and 58, respectively. In FIG. 3 the contact terminal 10 is shown oriented to circuit board 150 with the first terminal leg 32 disposed in through-hole 152 and the second, third and fourth terminal legs 34, 36, and 38 disposed in through-holes 154, 156 and 158 respectively.

Figure 4:
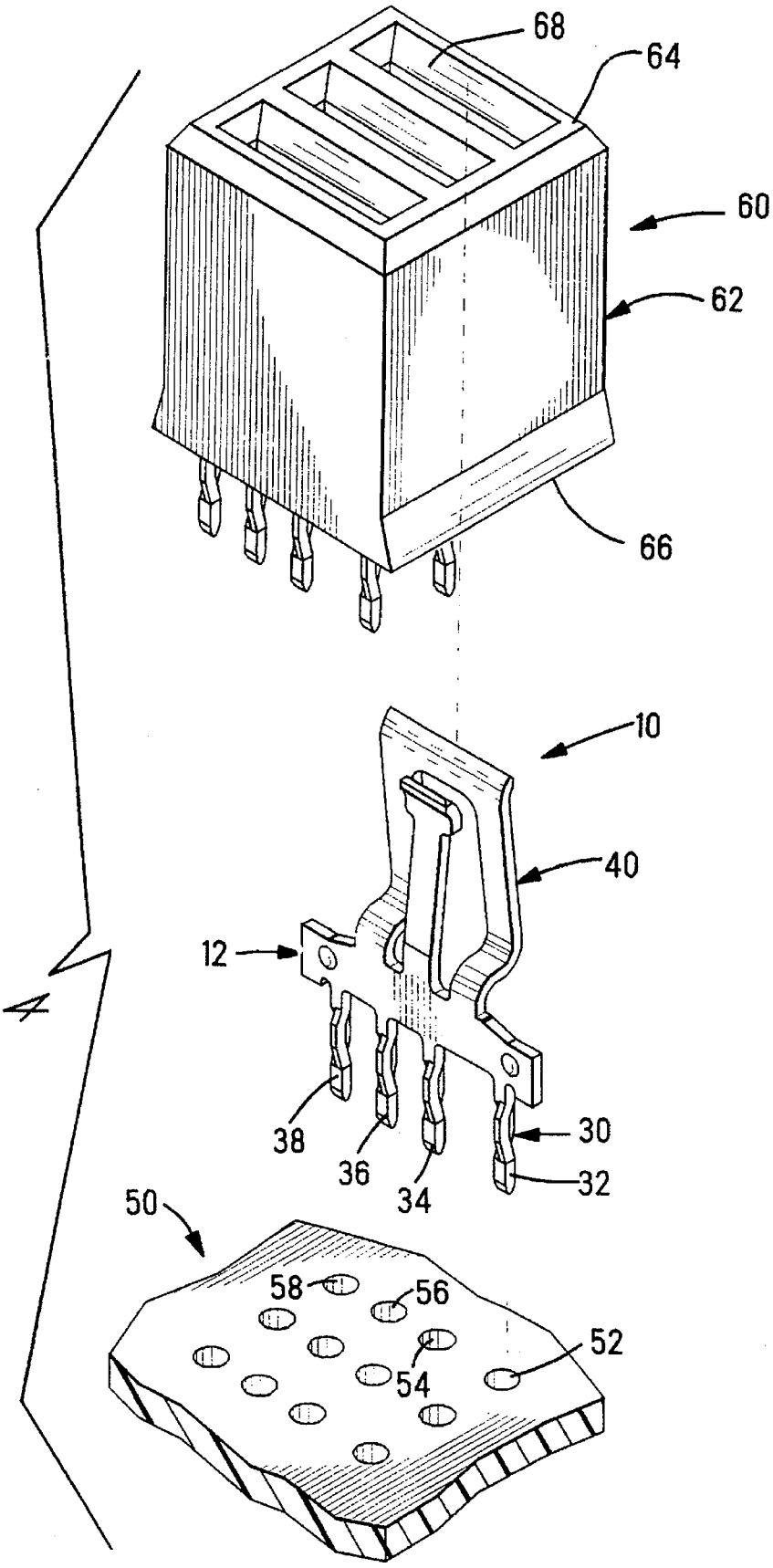
FIG. 4 is a perspective view of a receptacle connector having a plurality of contacts of FIG. 1 exploded from a circuit board.

FIG. 4 illustrates a power receptacle connector 60 exploded from a circuit board 50. Connector 60 has two contacts 10 disposed in respective cavities 68 and one contact 10 exploded from housing 62 and in alignment with respective through-holes in circuit board 50. As can be seen from this figure, the three contacts 10 and specifically the first leg 32 of each of the three identical contacts orient the connector 60 in a specific way to assure proper positioning of the connector on the circuit board.

Figure 5:
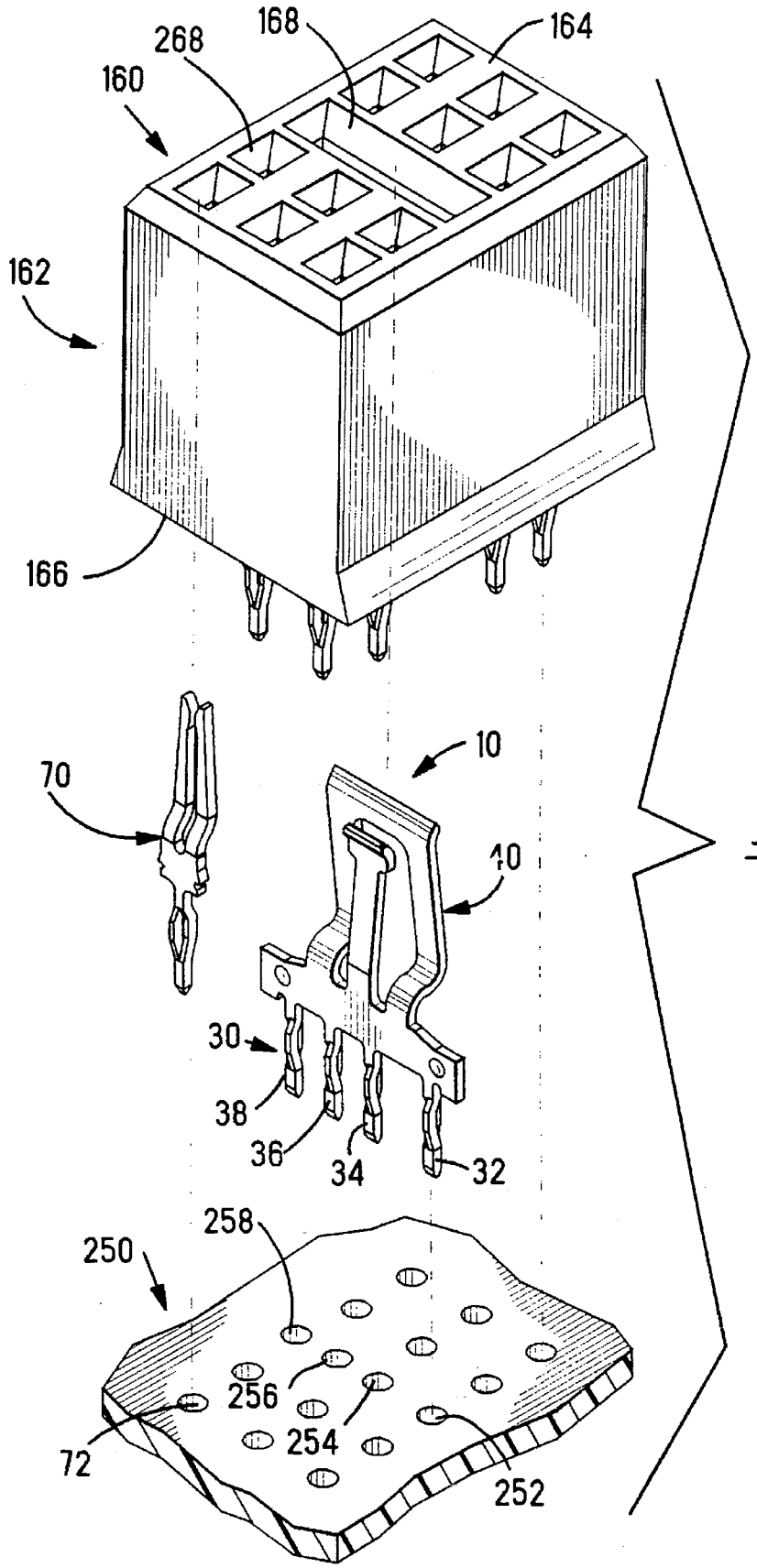
FIG. 5 is a perspective view of an alternative embodiment of a receptacle connector having a single contact of FIG. 1 and a plurality of other contacts.

FIG. 5 shows an alternative embodiment 160 of a connector assembly having one contact 10 and a plurality of signal contacts 70. The receptacle connector 160 includes a housing 162 having a mating face 164, a mounting face 166, a cavity 168 configured to receive terminal 10, and a plurality of cavities 268 configured to receive respective contacts 70. Circuit board 250 includes a column of through-holes 252, 254, 256 and 258 for receiving respective contact legs 32, 34, 36, 38 of contact 10 in a polarized orientation and an array of signal through-holes 72 for receiving the array of pin terminals 70.

Figure 6:
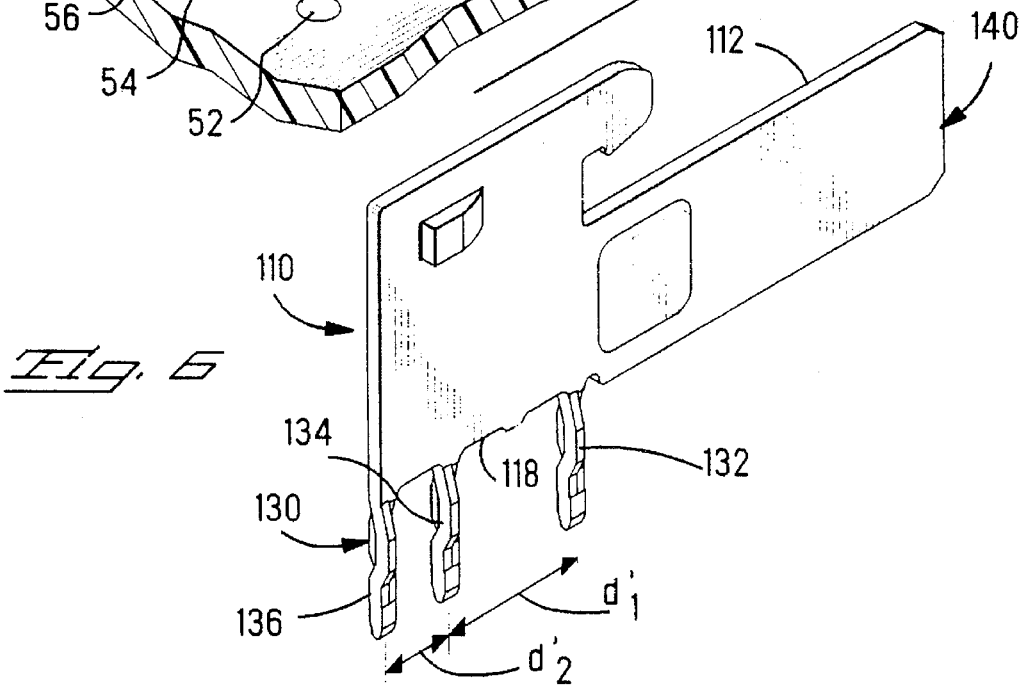
FIG. 6 is an alternative embodiment of an electrical contact made in accordance with the invention.

FIG. 6 shows an alternative embodiment 110 of a contact made in accordance with the invention. This contact includes a body 112 having first and second connecting portions 130, 140 and three legs 132, 134 and 136 extending from a common edge 118 of body 112. First leg 132 is spaced a distance $d_1'$ from second leg 134, which in turn is spaced a distance $d_2'$ from third leg 136.

As can be seen from the foregoing discussion the contact terminals of the present invention are self polarizing, cost effective to manufacture and eliminate the need for additional polarization features for mounting a connector to a circuit board.

It is thought that the electrical contact of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. An electrical contact for electrically interconnecting a circuit board and an other electrical article comprising:

a conductive body portion having first and second connecting sections at opposite ends thereof; and at least three legs extending from a common edge of said conductive body portion and aligned in a common row, altogether comprising one of said first and second connecting sections of said contact, each leg adapted to be received in a through-hole of a circuit board, the through-holes being aligned in a row, the other of said first and second connecting sections being adapted for becoming electrically connected with said other electrical article;

a first of said at least three legs being space from a second of said at least three legs a selected first distance and said second leg being spaced from a third of said at least three legs a selected second distance, said first distance being different from said second distance,;

whereby said at least three legs of said contact are adapted to be received in respective through-holes of the circuit board in a polarized arrangement.

2. The electrical contact of claim 1 wherein said first distance is greater than said second distance.

3. A connector assembly comprising:

a housing; and at least one electrical contact including a conductive body portion having first and second connecting sections at opposite ends thereof, and at least three legs extending from a common edge of said body portion and aligned in a common row, altogether comprising one of said first and second connecting sections of said contact, each leg adapted to be received in a through-hole of a circuit board, the through-holes being aligned in a row, the other of said first and second connecting sections being adapted for becoming electrically connected with said other electrical article, a first of said at least three legs being spaced from a second of said at least three legs a selected first distance and said second leg being spaced from a third of said at least three legs a selected second distance, said first distance being different from said second distance;

whereby said connector assembly thus defined need have no other polarizing feature for mounting said assembly to the circuit board.

4. The connector assembly of claim 3 wherein said first distance between said first and second legs is greater than said second distance between said second and third legs.

5. The connector assembly of claim 3 further including at least one other electrical contact.

6. The connector assembly of claim 5 wherein said first distance between said first and second legs of said electrical contact is greater than said second distance between said second and third legs of said electrical contact.

* * * * *